US005467707A

United States Patent [19]

Kanamaru

[11] Patent Number: 5,467,707

[45] Date of Patent: Nov. 21, 1995

[54] REVOLVING CAM-TYPE PRESS

[75] Inventor: Hisanobu Kanamaru, Hitachinaka, Japan

[73] Assignee: Hitachi, Ltd., Japan

[21] Appl. No.: 413,762

[22] Filed: Mar. 30, 1995

[30] Foreign Application Priority Data

Mar. 30, 1994 [JP] Japan ..... 6-060563

[51] Int. Cl.[6] ..... B30B 1/26

[52] U.S. Cl. ..... 100/292; 72/452; 74/60; 83/628

[58] Field of Search ..... 100/280, 281, 100/291, 292; 72/67, 406, 452; 83/602, 627, 628; 74/60

[56] References Cited

U.S. PATENT DOCUMENTS

| | | | |
|---|---|---|---|
| 3,673,951 | 7/1972 | Romer | 100/38 |
| 3,991,681 | 11/1976 | Antosiak | 100/292 |
| 4,776,259 | 10/1988 | Takai | 74/60 |
| 4,784,045 | 11/1988 | Terauchi | 74/60 |
| 5,315,926 | 5/1994 | Kanamaru et al. | 100/280 |

FOREIGN PATENT DOCUMENTS

| | | |
|---|---|---|
| 60-210398 | 10/1985 | Japan . |
| 5-309493 | 11/1993 | Japan . |

*Primary Examiner*—Stephen F. Gerrity
*Attorney, Agent, or Firm*—Evenson, McKeown, Edwards & Lenahan

[57] ABSTRACT

A revolving cam-type press includes a drive shaft supported by a crown and a middle plate, the drive shaft being adapted to be rotated by a drive device; a revolving cam fixedly mounted on the drive shaft; a fluctuating disk provided on an inclined surface of the revolving cam for converting a rotational output of the revolving cam into a reciprocal motion; sliders movably provided at an outer peripheral portion of the fluctuating disk for producing a pressing pressure; a plurality of fluctuation disk rotation-prevention pins extending through the fluctuating disk to be in parallel relationship to and in a concentric relationship to the drive shaft, the pins being fixedly secured at their one ends to a slider guide; and spherical bearings slidably mounted respectively on the other ends of the rotation prevention pins and engaged respectively in through holes formed through the fluctuating disk. A line passing through centers of the spherical bearings is disposed in a plane bisecting an intersection angle formed between an axis of the drive shaft and an axis of the fluctuating disk. With this construction, the rotation of the drive shaft is transmitted to the fluctuating disk at a uniform velocity, so that the transmission of torque between the drive shaft and the fluctuating disk is effected at a uniform velocity, thereby reciprocally moving the sliders without applying any external force to the slider.

9 Claims, 5 Drawing Sheets

REVOLVING CAM-TYPE PRESS

BACKGROUND OF THE INVENTION

1. Field of the Invention

This invention relates generally to a revolving cam-type press, and more particularly to a revolving cam-type press suited for forming a cold-extruded part, a blanked part, a drawn part and so on with a high degree of precision.

2. Description of the Related Art

Mechanical presses have heretofore been widely known. For example, Japanese Patent Unexamined Publication No. 60-210398 describes in FIGS. 1 and 5 a mechanical press in which a reciprocally-movable slider (17) is connected through a rod (15) to an outer peripheral portion of a fluctuating disk (13) movable about a drive shaft in a fluctuating manner.

A mechanism employing a revolving cam is known, for example, from U.S. Pat. No. 3,673,951. This mechanism is used in a fodder, and as seen from FIG. 6 of this U.S. patent, a fluctuating motion, caused by the rotation of the revolving cam (80), is converted into a rectilinear motion through a disk (88).

Japanese Patent Unexamined Publication No. 5309493 discloses a cam-type press on which the present invention is based.

This press comprises a revolving cam rotatable with a drive shaft, a fluctuating disk for fluctuating movement in accordance with the rotation of the revolving cam, and a plurality of fluctuating disk rotation-prevention pins provided on one side of the fluctuating disk facing opposite to the revolving cam to be parallel to the drive shaft, and arranged in a circle concentric with the drive shaft, each of these prevention pins having a spherical head. This construction is analogous to that of the present invention.

In the first-mentioned mechanical press making use of the fluctuating disk, since the fluctuating disk (13) is supported only by a movable shaft (6), a span between a point of force with respect to a working load during a pressing operation, and the movable shaft is large, and the rigidity of the fluctuating disk is low. As a result, it has been impossible to obtain a worked product of a high precision.

Moreover, a cross spider-type universal joint serves also as a rotation prevention pin mechanism for preventing the fluctuation disk from rotation with the drive shaft, and therefore this rotation prevention mechanism lacks sufficient rigidity and durability particularly for a large drive torque produced during a pressing operation.

Furthermore, since the universal joint itself is a non-uniform joint, a stable transmission of the rotation can not be obtained, and it creates a source of production of mechanical vibration and noises. Therefore, it can not be expected to provide a machine capable of producing products with a high working precision.

The latter mechanism is a revolving cam-type drive mechanism, and when an axial load is applied to the revolving cam upon rotation of the drive shaft, a radial load perpendicular to the drive shaft acts on the revolving cam. And besides, in an embodiment described in the above publication, any means for bearing an axial load is not provided at the back side of the revolving cam.

Therefore, when an axial load is exerted on the revolving cam, a large bending moment acts on the drive shaft. As a result, a large stress acts locally on portions of thrust-bearing balls interposed between the revolving cam and the disk, so that the lifetime of the balls is shortened, which results in damage to the machine.

Moreover, since the axis of fluctuating movement of the disk is offset from the axis of rotation of a universal joint, a bending moment developing at the drive shaft is large, and therefore a large rotation drive force is required, so that a stable fluctuating movement of the disk can not be expected. As a result, this mechanism fails to provide a stable revolving cam-type drive mechanism with high-precision, and therefore even if this mechanism is used, for example, in a pressing machine, such pressing machine will not be stable and high in precision.

In the press disclosed in the above-mentioned Japanese Patent Unexamined Publication No. 5-309493, the rotation prevention pins each having the spherical head prevent the fluctuating disk from rotation; however, a sliding portion of the rotation prevention pin is constituted by the pin itself, thus providing a heavy sliding movement, and also lateral stresses are applied to the rotation prevention pins during the fluctuating movement of the fluctuating disk, so that this mechanism exhibits a poor followability. And besides, it has been necessary to balance forces of compression springs provided above and below the pins so that the spherical heads of the pins can always be disposed in a concentric path about an axis of rotation. Therefore, high-precision component parts have been required, and hard to take charge of.

SUMMARY OF THE INVENTION

It is an object of this invention to provide a revolving cam-type press in which a uniform velocity is ensured with respect to joint portions, and mechanical vibrations as well as noises due to the rotation is low, and these features are achieved with a simple and easy construction.

Another object of the invention is to provide a revolving cam-type press in which a uniform velocity is ensured with respect to joint portions, and mechanical vibrations as well as noises due to the rotation is low, and a plurality of operations can be carried out in the same manner, and these features are achieved with a simple and easy construction.

According to one aspect of the present invention, there is provided a revolving cam-type press comprising:

a drive shaft supported by a crown and a middle plate, the drive shaft being adapted to be driven for rotation by a drive device;

a revolving cam fixedly mounted on the drive shaft;

a fluctuating disk provided on an inclined surface of the revolving cam for converting a rotational output of the revolving cam into a reciprocal motion;

a slider movably provided at an outer peripheral portion of the fluctuating disk for producing a pressing pressure;

a plurality of fluctuation disk rotation-prevention pins extending through the fluctuating disk in parallel relation to the drive shaft, the pins being arranged in a concentric relationship with the drive shaft, and being fixedly secured at their one ends to a slider guide; and spherical bearings slidably mounted respectively on the other ends of the rotation prevention pins, and engaged respectively in through holes formed through the fluctuating disk;

wherein a line passing through centers of the spherical bearings is disposed in a plane bisecting an intersection angle formed between an axis of the drive shaft and an axis of the fluctuating disk.

According to another aspect of the invention, there is provided a revolving cam-type press comprising:

a drive shaft supported by a crown and a middle plate, the drive shaft being adapted to be rotated by a drive device;

a revolving cam fixedly mounted on the drive shaft;

a fluctuating disk provided on an inclined surface of the revolving cam for converting a rotational output of the revolving cam into a reciprocal motion;

a main slider movably provided at an outer peripheral portion of the fluctuating disk for producing a pressing pressure;

a plurality of fluctuation disk rotation-prevention pins extending through the fluctuating disk in parallel relation to the drive shaft, the pins being arranged in a concentric relationship with the drive shaft, and being fixedly secured at their one ends to a slider guide;

spherical bearings slidably mounted respectively on the other ends of the rotation prevention pins, and engaged respectively in through holes formed through the fluctuating disk; and an auxiliary piston device pivotally connected to the outer peripheral portion of the fluctuating disk for actuating an auxiliary slider;

wherein a line passing through centers of the spherical bearings is disposed in a plane bisecting an intersection angle formed between an axis of the drive shaft and an axis of the fluctuating disk.

DESCRIPTION OF THE PREFERRED EMBODIMENT

One preferred embodiment of the present invention will now be described with reference to FIGS. 1 to 6.

Figure 1:
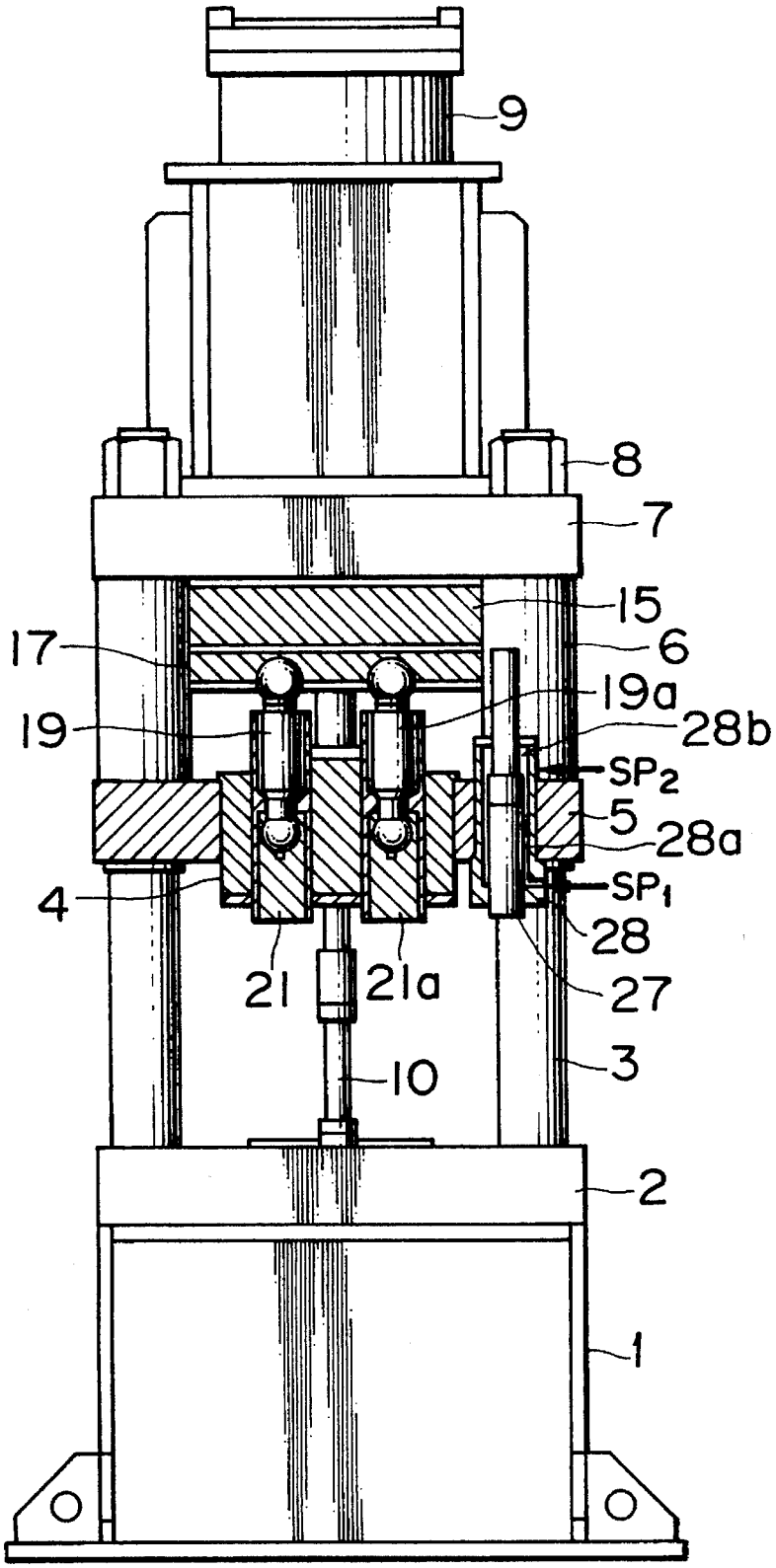
FIG. 1 is a partly cross-sectional, front-elevation view of a revolving cam-type press of the present invention.
Figure 2:
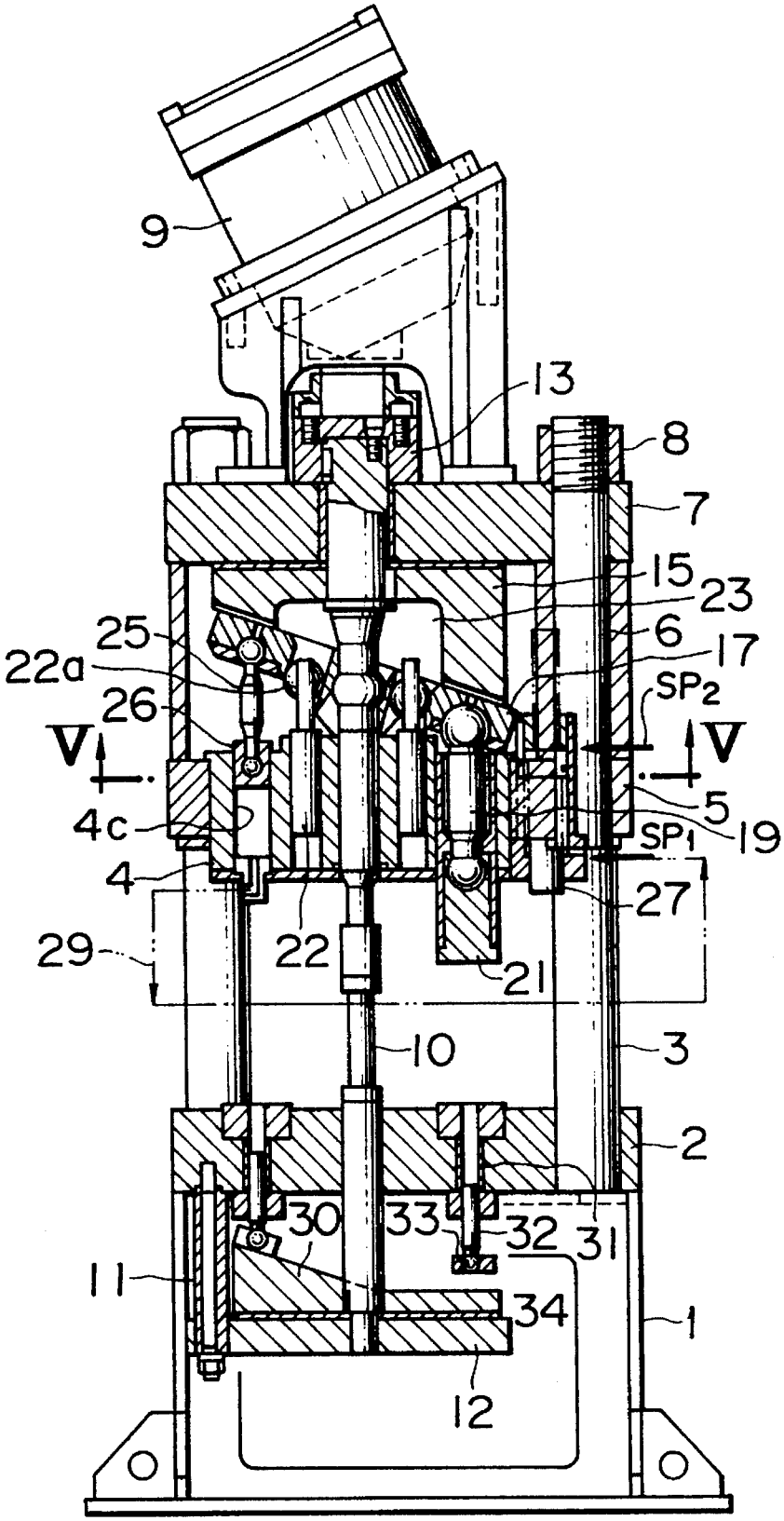
FIG. 2 is a partly cross-sectional side-elevational view of the press of FIG. 1.

FIG. 1 is a partly cross-sectional, front-elevation view of a pressing machine of the present invention, and FIG. 2 is a partly cross-sectional side-elevational view of an essential portion of the pressing machine. In these Figures, a bolster 2 is fixedly mounted on a base 1, and tie rods 3 are mounted respectively on four corner portions of an upper surface of the bolster 2 to extend vertically. A middle plate 5, incorporating a slider guide 4 therein, is mounted on intermediate portions of the tie rods 3, and a crown 7 is mounted on upper portions of the tie rods 3 through upright members 6 to be fastened thereto by nuts 8. Here, to firmly fasten the middle plate 5 in a stable manner, a step portion is formed on the intermediate portion of each of the tie rods 3, and the middle plate 5 is mounted on these step portions through a spacer.

A hydraulic motor 9 (which may be replaced by an electric motor) serving as a drive source is fixedly mounted on the crown 7 by fixing means (not shown). A drive shaft 10 extends through the crown 7, the middle plate 5 and the bolster 2, and is further rotatably supported through a bearing metal on a knockout plate 12 supported by the bolster 2 through rods 11. An upper end (input end) of the drive shaft 10 is connected to an output shaft of the hydraulic motor 9 through a coupling 13.

Figure 3:
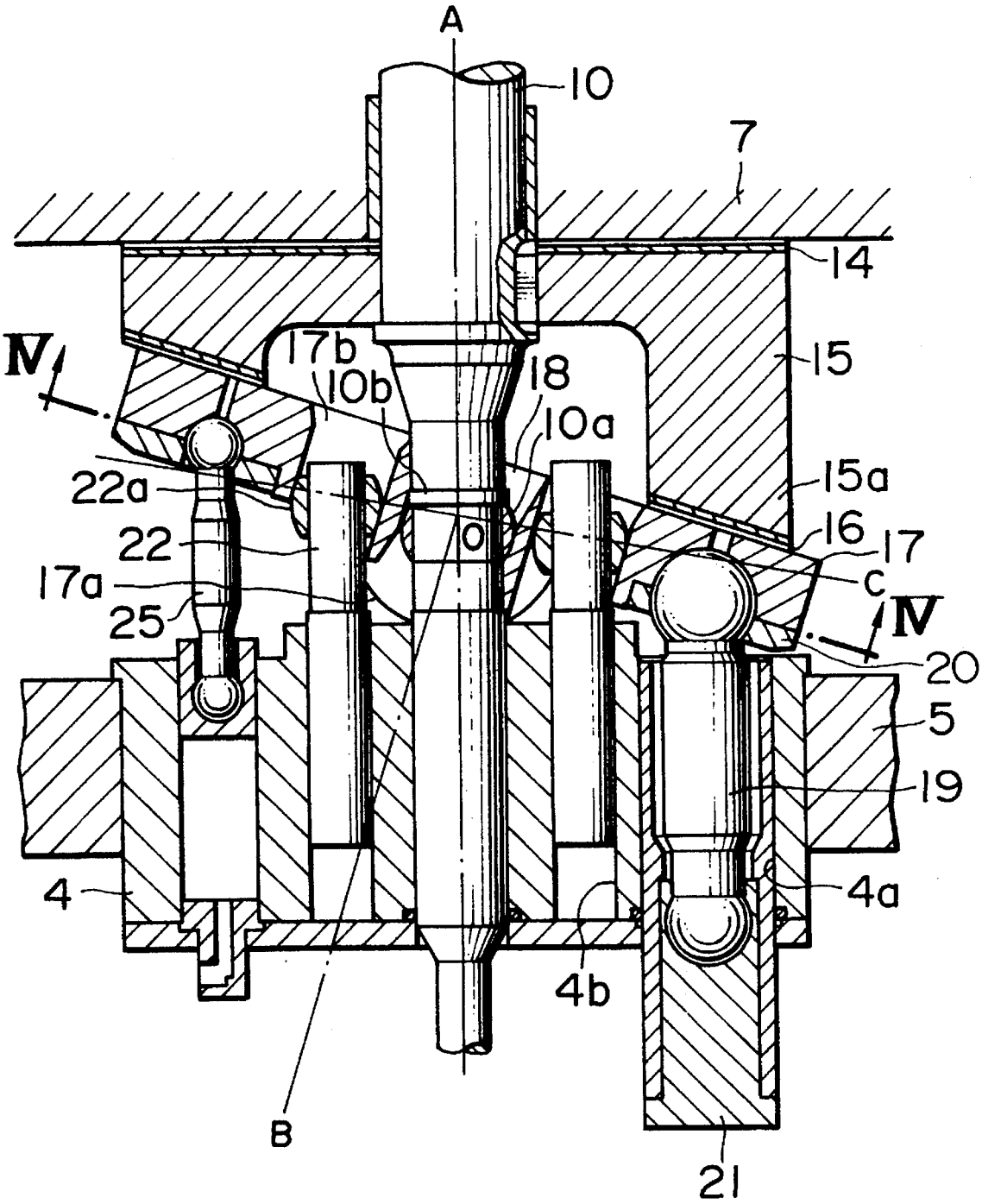
FIG. 3 is an enlarged, cross-sectional view of a drive portion of FIG. 2 taken generally along the line III—III of FIG. 4.

A revolving cam 15 is fixedly mounted on that portion of the drive shaft 10 disposed between the crown 7 and the middle plate 5, and is held at its one side in sliding contact with the crown 7 through a bearing metal 14, as best shown in FIG. 3. A fluctuating disk 17 is held in sliding contact with the other side of the revolving cam 15 through a bearing metal 16 so that this fluctuating disk 17 is movable in a fluctuating manner. A semi-spherical surface 17a is formed integral with a central portion of the fluctuating disk 17, and projects downwardly therefrom, and this spherical surface has a central hole 18 extending vertically through the central portion of the disk 17. The semi-spherical surface 17*a* faces the upper surface of the slider guide 4 in a pivotal manner, and preferably is disposed in a spherical contact with this upper surface.

A central bearing 10a, comprising a hard ball of die steel or the like, is slidably mounted on the drive shaft 10, and is engaged with the inner peripheral surface of the central hole 18. A flange 10*b* formed integral with the drive shaft 10 (the flange 10*b* may be provided separate from the drive shaft 10, and be fixedly secured thereto) limits an upward movement of the spherical bearing 10*a*.

Connecting rods 19 and 19*a* are pivotally held at their one ends on a portion (which serves as a press-operating surface) of the lower surface of the fluctuating disk 17 through a support plate 20, each connecting rods 19 and 19*a* having generally spherical opposite ends. The connecting rods 19 and 19*a* are disposed in vertical registry with a cylindrical peripheral wall 15*a* of the revolving cam 15. As can be seen from FIG. 2, the other end of the connecting rod 19 is pivotally connected to a slider 21 supported by a cylinder 4*a* of the slider guide 4.

Figure 4:
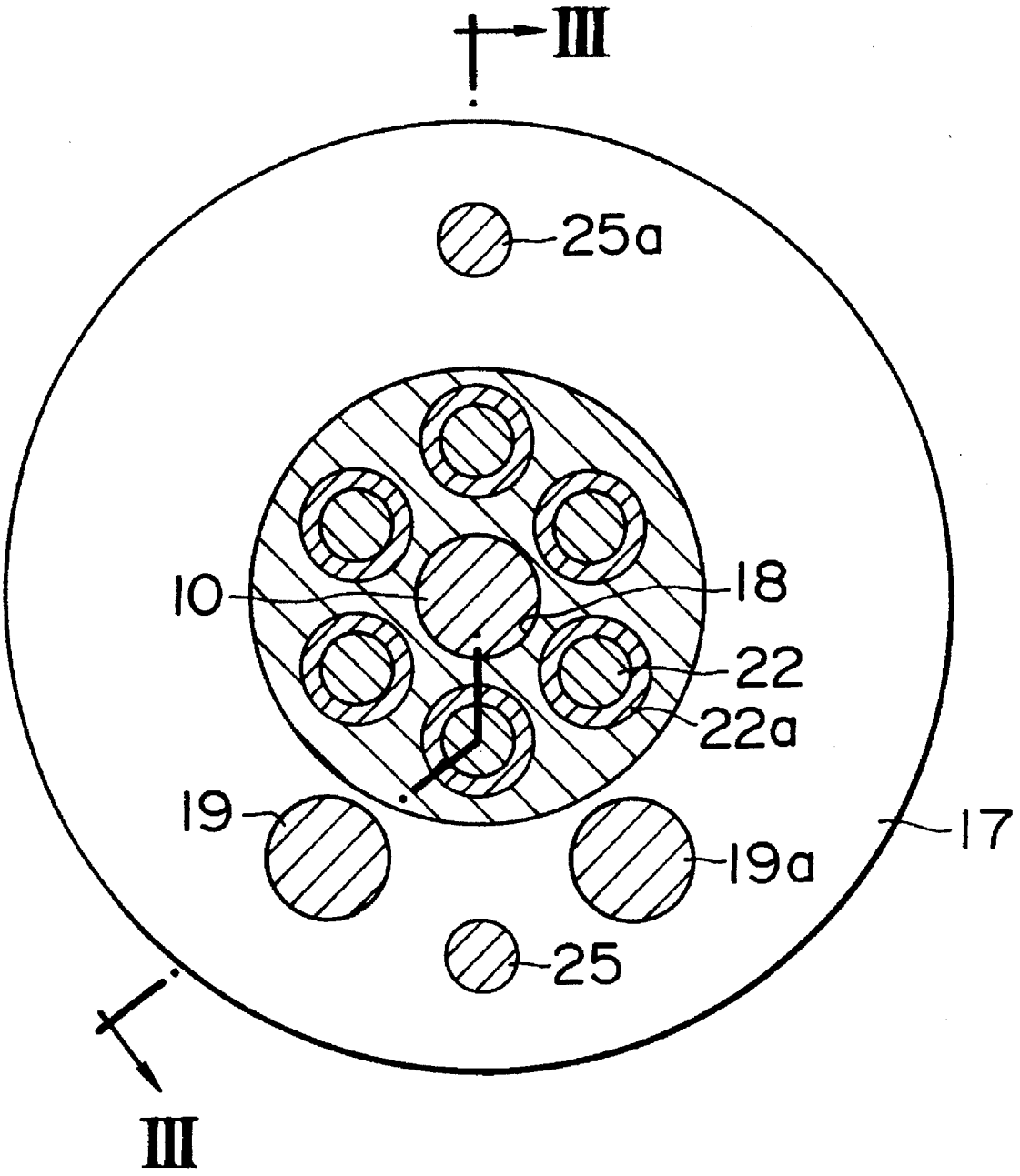
FIG. 4 is a cross-sectional view taken along the line IV—IV of FIG. 3.
Figure 5:
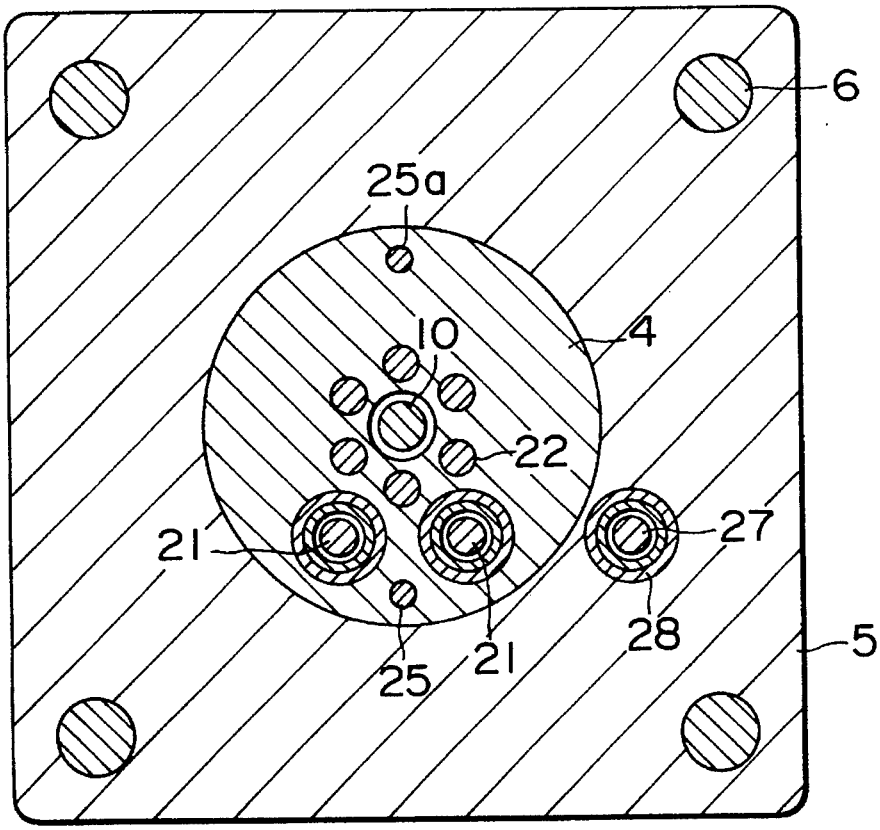
FIG. 5 is a cross-sectional view taken along the line V—V of FIG. 2.

As can be seen from FIGS. 3 and 4, six cylinders 4*b* are concentrically and circumferentially equidistantly formed on the slider guide 4. A rotation prevention pin 22 is press-fitted in and fixedly secured to each of the cylinders 4*b*, and a free end portion of each prevention pin 22 is engaged in a corresponding through hole 17*b* in the fluctuating disk 17 through a spherical bearing 22*a* (which is slidably mounted on the pin 22) so as to allow a fluctuating movement of the fluctuating disk 17.

The fluctuating disk 17 and the slider guide 4, integrally connected to the drive shaft 10, are connected together through the plurality of rotation prevention pins 22. The axis A of the drive shaft 10 and the axis B of the fluctuating disk 17 intersect each other at an angle $\alpha$ (160°) at a center point O of the central bearing 10*a*. A straight line C, extending between symmetrically-disposed points through the center of the central bearing 10*a*, lies in a plane which divides the intersection angle $\alpha$ into two equal parts, and the central bearing 10a is held on this line in a self-aligned manner.

In FIG. 4, auxiliary pistons 25 and 25*a* are disposed outside of a circle of the rotation prevention pins 22, and are circumferentially spaced 180° from each other. In a similar manner as described above for the connecting rod 19, one end of the auxiliary piston is held on the fluctuating disk 17 and the other end thereof is received in a corresponding cylinder 4*c* of the slider guide 4 through a slider 26. An auxiliary slider 27 for an auxiliary press is provided in juxtaposed relation to the slider 21, and is held on the middle plate 5 through an auxiliary slider guide 28. A lower chamber 28*a* of the cylinder communicates with a compression chamber of the cylinder 4*c* via a pipe 29, and an upper chamber 28*a* of the cylinder communicates with another cylinder chamber (not shown).

The joint device in the present invention will now be described in view of the principle of uniform velocity. In FIG. 3, A represents the axis of rotation of the drive shaft 10, B represents the axis of fluctuating movement of the fluctuating disk 17, and C represents the line passing through the centers of the spherical bearings 22*a* of the rotation prevention pins 22, and their geometrical relation is shown in FIG. 6.

Figure 6:
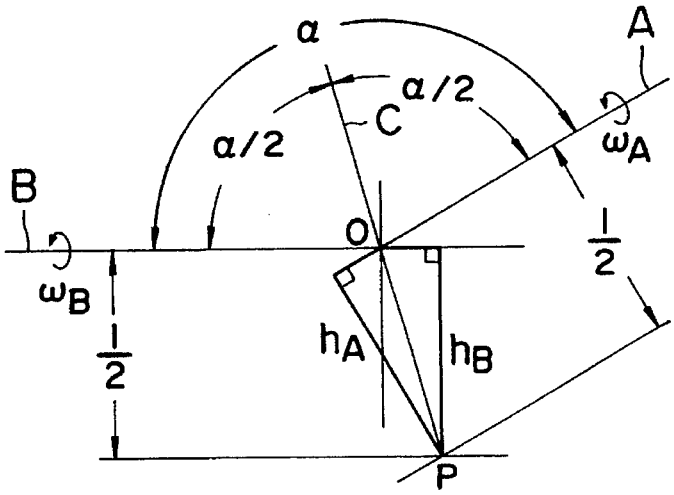
FIG. 6 is an illustration showing a geometrical relation of a joint mechanism of FIG. 3.

In FIG. 6, the axis (centerline) of the drive shaft 10 is referred to as the drive axis A, and the axis (centerline) of the fluctuating disk 17 is referred to as the driven axis B. Then, the angle of intersection of the drive axis A and the driven axis B is $\alpha$. The angle of inclination of the plane C, which includes the straight line passing through the centers of the spherical bearings 22*a* of two rotation prevention pins 22 as shown in FIG. 3, with respect to the drive axis A is $\alpha/2$. Namely, the power transmission points are always located in the plane which bisects the angle $\alpha$ of intersection of the drive and driven axes A and B, and by doing so, the requirement for the uniform velocity is satisfied. Therefore, the rotation of the drive axis A is transmitted to the driven axis B at a uniform velocity, and hence the transmission of torque between the drive shaft 10 and the fluctuating disk 17 is effected at a uniform velocity, so that the slider 21, which decides the performance, can be reciprocally moved without being exerted by any external force.

In FIG. 6, a point P represents the center of the spherical bearing 22*a*, and serves as the power transmission point. Where hA represents a perpendicular drawn from the point P to the axis A, and hB represents a perpendicular drawn from the point P to the axis B, a straight line between the point P and the point O bisects the intersection angle $\alpha$, and therefore hA=hB holds good. Where $\omega A$ represents an angular velocity of the drive axis A of the drive shaft 10, and $\omega B$ represents an angular velocity of the driven shaft, peripheral speeds of the axes A and B around the point P are represented by $\omega A \cdot hA$ and $\omega B \cdot hB$, respectively.

Each rotation prevention pin 22 is fixedly secured to the slider guide 4, and the rotational angle of the revolving cam 15 is constant, and therefore the point P is unchanged. Therefore, these peripheral speeds are equal ($\omega A \cdot hA = \omega B \cdot hB$). Therefore, $\omega A = \omega B$ holds good, and if the power transmission point P is always located in the plane which bisects the angle $\alpha$ of intersection of the two axes, rotation is transmitted at a uniform velocity.

In the above construction, the spherical bearings 22*a* for the rotation prevention pins 22 are always located in the path on the concentric circle, and therefore the slider 21, which decides a pressing precision, can be reciprocally moved without being exerted by an external force e.g. an unbalanced load.

Therefore, even if a bending stress necessary for the transmission of torque is exerted on the rotation prevention pin, the spherical bearing can be moved axially without strain, and the machine exhibits a high followability regardless of the rotational speed. As a result, naturally, mechanical vibrations and noises resulted from rotation are overcome, and the pressing machine of a high practicality can be provided with a simple construction.

As for the operation of the auxiliary press mechanism, when the auxiliary piston 25*a* moves downward in accordance with the fluctuating movement of the fluctuating disk 17, pressurized oil Sp1 is supplied from the compression chamber of the cylinder 4*c* to the lower chamber 28*a* of the cylinder of the auxiliary press device via the pipe 29 to move the auxiliary slider 27 upward. The downward movement of this slider 27 is effected by pressurized oil Sp2 produced when the other auxiliary piston located 180° from the auxiliary piston 25*a* moves downward. This operation can be carried out according to the need, for example, by switching an associated valve.

In the above embodiment of the present invention, the rotation prevention pins 22 are fixedly mounted on the slider guide 4 in the uniform-velocity arrangement, and the spherical bearing 22*a* is slidably mounted on the other end of each pin 22, which in turn is connected to the fluctuating disk 17 through their respective spherical bearings 22*a*. With this arrangement, the spherical bearings can be slidingly moved in accordance with the position of the revolving cam 15.

Therefore, even if a bending stress necessary for transmission of torque would be exerted on the rotation prevention pin, the spherical bearing 22*a* can be moved axially without strain, and the machine exhibits a high followability regardless of the rotational speed. As a result, naturally, mechanical vibration and noises resulted from rotation are overcome, and the pressing machine of a high practicality can be provided with a simple construction.

The rotation prevention mechanism for the fluctuating disk 17 transmits a rotational drive force to the fluctuating disk 17 at a uniform velocity, and therefore even in the revolving cam-type press, vibrations will not occur at the rotation prevention mechanism, so that a high mechanical efficiency with low noises can be achieved. The plurality of rotation prevention pins 22 are provided radially inwardly of the sliders, which have a small drive torque, and therefore these pins 22 may have a relatively small diameter. Further, since the rotation prevention force can be allotted to the plurality of pins 22, there can be provided the pressing machine which is highly reliable in terms of the mechanical strength though being of a small size, and has a prolonged lifetime.

About 10 percent of the pressing load acts on the fluctuating disk during the pressing operation, but since the spherical bearing is slidably mounted on the drive shaft so that part of the drive shaft can receive such load, this arrangement is stable in terms of the strength.

Moreover, since the revolving cam 15 bears the entire load just therebelow during the pressing operation, the machine has a high rigidity as well as a high mechanical efficiency.

In the above embodiment, since a tensile force, produced when the slider 21 is disengaged from a workpiece (not shown), is born by the semi-spherical surface 17*a* formed at the central portion of the fluctuating disk 17, the machine can well withstand such a tensile force.

Furthermore, since the slide guide 4 is provided separately from the middle plate 5, it can be replaced by another one as desired, and therefore the machine can be easily standardized.

In the present invention, the fluctuating disk rotation-prevention pins each having the spherical bearing slidably mounted thereon are fixedly secured at their one ends to the slider guide, and the line passing through the centers of the spherical bearings is disposed in a plane bisecting the intersection angle formed between the axis of the drive shaft and the axis of the fluctuating disk. With this arrangement, there can be simply and readily provided the revolving cam-type press in which a uniform velocity is ensured for the joint portions, and mechanical vibrations and noises resulted from rotation are low.

What is claimed is:

1. A revolving cam-type press comprising:

a drive shaft supported by a crown and a middle plate, said drive shaft being adapted to be rotated by a drive device;

a revolving cam fixedly mounted on said drive shaft;

a fluctuating disk provided on an inclined surface of said revolving cam for converting a rotational output of said revolving cam into a reciprocal motion;

slider means movably provided at an outer peripheral portion of said fluctuating disk for producing a pressing pressure;

a plurality of fluctuation disk rotation-prevention pins extending through said fluctuating disk to be in parallel relationship to and in a concentric relationship to said drive shaft, said pins being fixedly secured at their one ends to a slider guide; and spherical bearings slidably mounted respectively on the other ends of said rotation prevention pins, and engaged respectively in through holes formed through said fluctuating disk;

wherein a line passing through centers of said spherical bearings is disposed in a plane bisecting an intersection angle formed between an axis of said drive shaft and an axis of said fluctuating disk.

2. A press according to claim 1, in which said fluctuating disk is supported by said drive shaft through a central bearing.

3. A press according to claim 2, in which said central bearing is slidably mounted on said drive shaft, said drive shaft having a stopper for limiting a sliding movement of said central bearing.

4. A press according to claim 1, in which said fluctuation disk rotation-prevention pins are secured to said slider guide by press-fitting.

5. A press according to claim 1, in which said slider means is removably mounted on said middle plate.

6. A revolving cam-type press comprising:

a drive shaft supported by a crown and a middle plate, said drive shaft being adapted to be rotated by a drive device;

a revolving cam fixedly mounted on said drive shaft;

a fluctuating disk provided on an inclined surface of said revolving cam for converting a rotational output of said revolving cam into a reciprocal motion;

main slider means movably provided at an outer peripheral portion of said fluctuating disk for producing a pressing pressure;

a plurality of fluctuation disk rotation-prevention pins extending through said fluctuating disk to be in parallel relationship to and in a concentric relationship to said drive shaft, and said pins being fixedly secured at their one ends to a slider guide;

spherical bearings slidably mounted respectively on the other ends of said rotation prevention pins, and engaged respectively in through holes formed through said fluctuating disk; and an auxiliary piston device pivotally connected to the outer peripheral portion of said fluctuating disk for actuating an auxiliary slider;

wherein a line passing through centers of said spherical bearings is disposed in a plane bisecting an intersection angle formed between an axis of said drive shaft and an axis of said fluctuating disk.

7. A press according to claim 6, in which said piston device comprises a pair of pistons which are disposed radially outwardly of said rotation prevention pins and concentrically and equidistantly on said fluctuating disk.

8. A press according to claim 7, in which said auxiliary slider is provided in juxtaposed relationship to said main slider means.

9. A press according to claim 6, in which said slider means is removably mounted on said middle plate.

* * * * *